United States Patent [19]

Erickson et al.

[11] 4,213,268

[45] Jul. 22, 1980

[54] MULTI-STAGE VEHICLE TOY

[75] Inventors: Erick E. Erickson, Chicago; John R. Wildman, North Riverside; Burton C. Meyer, Downers Grove, all of Ill.

[73] Assignee: Marvin Glass & Associates, Chicago, Ill.

[21] Appl. No.: 7,337

[22] Filed: Jan. 29, 1979

[51] Int. Cl.[2] ..... A63H 17/14

[52] U.S. Cl. ..... 46/202; 124/61

[58] Field of Search ..... 46/1 K, 201, 202, 204, 46/206, 208, 209

[56] References Cited

U.S. PATENT DOCUMENTS

| | | | |
|---|---|---|---|
| 2,791,867 | 5/1957 | Dasher | 46/202 X |
| 3,740,896 | 6/1973 | Glass et al. | 46/206 |
| 3,895,459 | 7/1975 | Morrison et al. | 46/202 |
| 4,005,543 | 2/1977 | McKay | 46/202 X |
| 4,045,908 | 9/1977 | Ensmann et al. | 46/204 |

FOREIGN PATENT DOCUMENTS

| | | | |
|---|---|---|---|
| 2205825 | 5/1974 | France | 46/204 |

*Primary Examiner*—F. Barry Shay

*Attorney, Agent, or Firm*—Mason, Kolehmainen, Rathburn & Wyss

[57] ABSTRACT

A multi-stage toy vehicle includes a front portion having wheel means supporting the vehicle for rolling movement and a separate, rear portion initially nested with the front portion and also having wheels for supporting the vehicle. A detachable connector is provided between the nested together portions of the vehicle for retaining the portions in a nested condition as the vehicle is initially launched from a launching device. A biasing element is provided for ejecting the front portion of the vehicle away from the rear portion after the vehicle is launched and rolling. The launching device provides an impact against the vehicle while the front and rear portions are nested together to initially propel the vehicle from the launcher and this impact releases the detachable connector so that the biasing element is effective to eject the front portion away from the rear portion as the rolling friction begins to decrease, thus, providing a multi-stage effect. The launching device is a piston mounted in a chamber pressurized by a manual pump. Manually movable trigger means releasably blocks the piston movement.

13 Claims, 6 Drawing Figures

MULTI-STAGE VEHICLE TOY

BACKGROUND OF THE INVENTION

1. Field of the Invention

The present invention relates to toy vehicles and more particularly to rolling toy vehicles having a pair of separate but initially nested together portions each independently supported for rolling movement and adapted to be launched on impact from a launching device so that after an initial launching movement while in a nested condition, the front portion of the vehicle is then ejected away from the rear portion to provide a staging effect as the vehicle slows down.

2. Description of the Prior Art

A wide variety of rolling vehicle toys have provided youngsters with long hours of play and amusement. U.S. Pat. Nos. 3,046,694; 3,091,052; 3,232,001; 3,711,991; 3,740,896; 3,789,540; 3,792,549; 3,859,752; 3,895,459; 3,936,052 and 4,087,935 disclose a variety of vehicles and/or projectiles and different types of launching devices and types of staging action.

OBJECTS OF THE PRESENT INVENTION

It is an object of the present invention to provide a new and improved wheeled toy vehicle.

More particularly, it is an object of the invention to provide a wheeled toy vehicle having separate front and rear portions each independently wheel supported and adapted to be initially launched with the portions in a nested condition for later separation to provide a staging type action.

Another object of the invention is to provide a new and improved toy vehicle combination of the character described employing a launching device for impact propulsion of the vehicle.

Another object of the invention is to provide a vehicle wherein after an initial launching thrust, separate but initially nested together vehicle portions are forcefully separated from one another to provide a multi-stage effect.

It is yet another object of the present invention to provide a new and improved toy vehicle combination of the character described which is amusing to play with and which can be readily built in mass production processes.

Yet another object of the invention is to provide a wheeled toy vehicle which is operable to simulate a multi-stage effect that is provided in real life rockets and space vehicles.

SUMMARY OF THE INVENTION

The foregoing and other objects and advantages of the present invention are accomplished in an illustrative embodiment comprising a new and improved toy vehicle which includes separate front and rear vehicle portions having wheels for rolling support and initially nestable together as a unit for launching from a companion launching or propelling device. A biasing element is provided between the separable portions of the vehicle and is effective for ejecting the forward portion away from the rearward portion after initial launching impact has released a detachable connecting latch between the separate portions. The latch is effective prior to launch to retain the separate vehicle portions nested together as a unit.

BRIEF DESCRIPTION OF THE DRAWINGS

For a better understanding of the invention reference should be had to the following detailed description taken in conjunction with the drawings, in which.

DESCRIPTION OF THE PREFERRED EMBODIMENT

Figure 1:
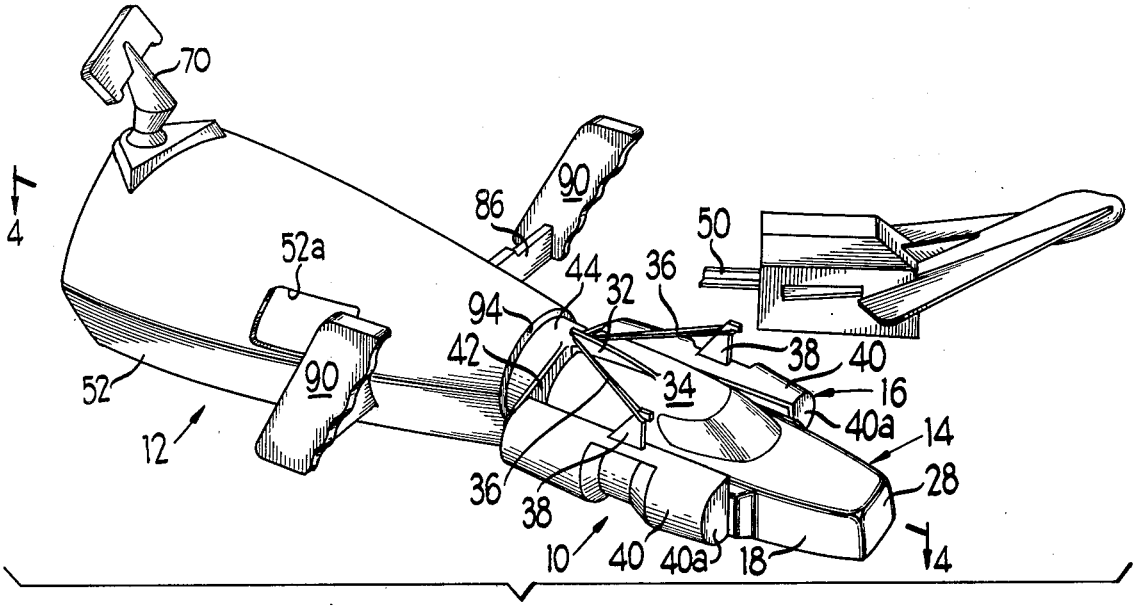
FIG. 1 is a perspective view of a new and improved toy vehicle and launcher shown in a condition ready for launching of the vehicle.
Figure 2:
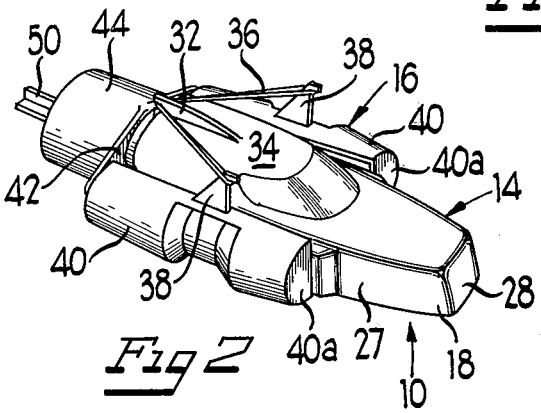
FIG. 2 is a perspective view illustrating a novel toy vehicle in accordance with the invention with separate front and rear portions nested together.
Figure 3:
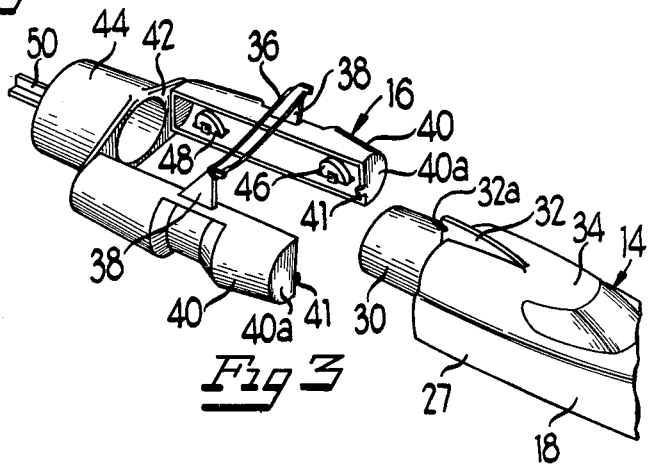
FIG. 3 is a perspective view of the toy vehicle of the present invention shown after a final staging action has taken place separating the front and rear vehicle portions.

Referring now more particularly to the drawings, in FIG. 1 is illustrated a new and improved toy vehicle 10 and launcher 12 and in a ready to launch condition prior to launching the vehicle forwardly by impact force. The toy vehicle 10 including a front or a forward vehicle portion 14 independently wheeled for rolling movement over a supporting surface and detachably connected and nestable with a rear vehicle portion 16 which is separable from the front vehicle as shown in FIG. 3. Each vehicle portion is independently supported for rolling movement on a supporting surface such as a rug or floor and the separate vehicle portions are adapted to be detachably interconnected together in a nested relationship as shown in FIGS. 1, 2, 4 and 5 but are separable from one another as illustrated in FIG. 3 to provide a multi-stage action simulating that of a multi-stage, missile, rocket or the like.

The front vehicle 14 includes a body 18 formed of integrally molded plastic material generally open on the underside and is provided with a pair of front wheels 20 mounted on a front axle 22 internally of the body shell and a pair of larger rear wheels 24 having rubber tires and carried on a rear axle 26, also mounted internally of the body shell. The spacing between the rear wheels 24 is larger than that between the front wheels 20 so that the front vehicle 14 is directionally stable and tends to move along a straight line when propelled forwardly on a supporting floor surface.

The wheel axles 22 and 26 extend transversely between opposite inside surfaces of a pair of opposite side walls 27 and at the forward end of the vehicle these side walls taper inwardly to provide a narrow nose portion 28 with a relatively blunt forward end wall.

At the rearward end, the front vehicle 14 is formed with an integral cup-shaped, rearwardly projecting, generally cylindrical, tail connector 30 which resembles the outlet nozzle of a jet engine or the like and the connector is coaxially centered along the longitudinal axis of the vehicle.

A central fin or vertical stabilizer 32 is integrally formed on an upper or top wall 34 of the vehicle body centered between the side walls 27. The fin is provided with a notch **32*a* in the rearward edge in order to accommodate an elongated elastic band such as a rubberband loop 36 used for ejecting or biasing the front vehicle 14 outwardly away from the rear vehicle 16** out of the nested position to provide a staging type action.

The opposite outer ends of the rubberband 36 are looped around a pair of vertical fins 38 integrally molded to project upwardly from top portions of a pair of longitudinally extending side wall members 40 of the rear vehicle 16. At the rearward end, the side members 40 are interconnected by a transverse web 42 of relatively thin wall construction and the web is formed with an integral cup-shaped, female receptacle 44 extending rearwardly thereof and dimensioned to slideably receive the male connector 30 on the forward vehicle 14 when the rear and front vehicles are nested together as shown in FIGS. 1, 2, 4 and 5.

Figure 4:
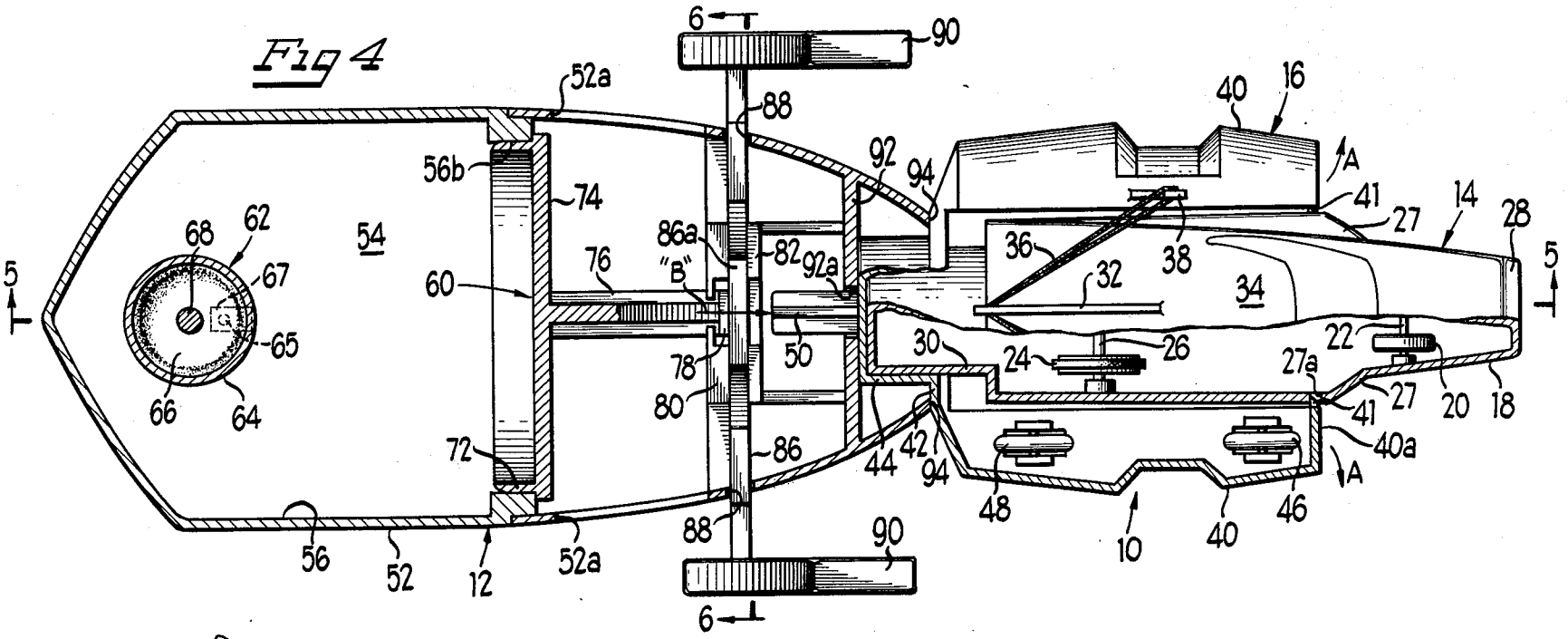
FIG. 4 is a longitudinal cross-sectional view taken substantially along lines 4—4 of FIG. 1.

When the connector 30 on the front vehicle is seated in the socket 44 at the rearward end of the rear vehicle the vehicles are centered in longitudinal alignment in the nested position. This position insures that clearance spaces are provided between the opposite side walls 27 on the front vehicle 14 and the inside edge surfaces of the side walls 40 on the rear vehicle 16 as best shown in FIGS. 3 and 4 so that subsequently, the front vehicle can be clearly ejected away from the rear vehicle. The male projection 30 and the female socket 44 provide a detachable, self-aligning connector system between the two vehicles so that the forward vehicle 14 will be accurately guided out of a forwardly opening recess formed by the rear vehicle 16 between the longitudinal side members 40 and the thin transverse web 42 at the rear end.

Figure 5:
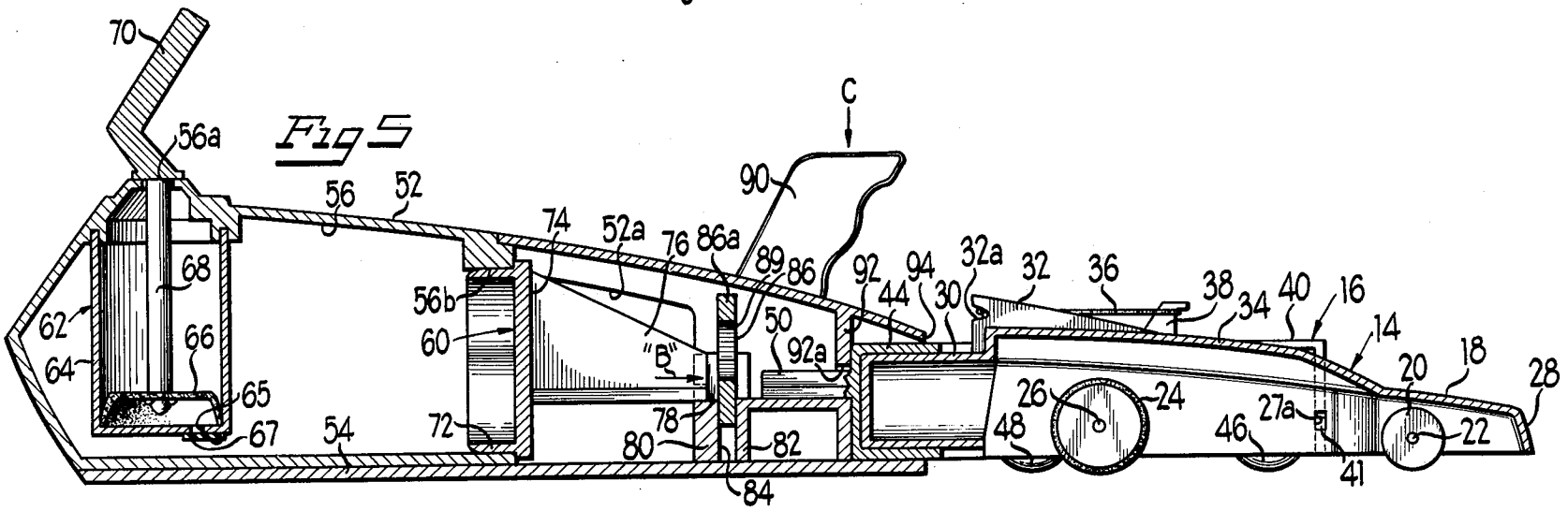
FIG. 5 is a longitudinal, cross-sectional view taken substantially along lines 5—5 of FIG. 4.

In order to retain the front and rear vehicles in the nested together position as shown prior to launching, forward wall portions **40*a* on the side members 40 of the rear vehicle 16 are formed with inwardly extending latch fingers 41 which latchingly engage into recesses 27*a* formed in the opposite side walls 27 on the forward vehicle 14 as best shown in FIGS. 4 and 5. This latched engagement between the fingers 41 and the surfaces of the recesses 27*a* is sufficient to retain the front vehicle 14 in the nested position in the recess of the rear vehicle 16 against the forward biasing force of the stretched rubberband 36 until the latch fingers 41** are released during the launching process.

After launching engagement has been released, the vehicles 14 and 16 continue to move together as a single unit still in nested relation until rolling frictional forces on the separate vehicles begins to be reduced and at this time, the biasing force of the stretched rubberband 36 is sufficient to forcefully eject or stage the front vehicle 14 away from the rear vehicle 16. This second ejection between the two vehicles 14 and 16 occurs at an interval after both vehicles have been launched together and propelled away from the launcher 12, and thus provides a multiple stage action.

The rear vehicle 16 is generally U-shaped as illustrated in FIGS. 3 and 4 to provide a recess for the more conventionally shaped front vehicle 14 and is supported for independent, rolling movement over a supporting surface on a pair of front wheels 46 and rear wheels 48. Each of the wheels are carried on short axles and projecting downwardly through a slot or opening in a bottom wall portion of a side member 40 of the vehicle shell.

The transverse web portion 42 is relatively thin and flexible so that the forwardly projecting, longitudinally extending side members 40 are easily spread outwardly at the forward end upon the impact of launching by the launcher 12 thereby releasing the latch fingers 41 from latched engagement with the notches or detents **27*a* in in side walls of the front vehicle 14. When the rear wall of the cup shaped alignment socket 44 on the vehicle 16 is subjected to an impact blow or force, the thin web 42 readily flexs to release the latch fingers 41. A rearwardly projecting tang 50 is formed to extend rearwardly of the rear wall of the socket 44 and the tang is adapted to project into the forward end of the launcher 12 when the vehicle 10** is positioned ready for a launch.

The launcher 12 includes a relatively large hollow body 52 shaped to generally resemble a nose section of a space vehicle or rocket and is tapered from a large, oval-shaped, transverse cross-section at the rearward end portion toward a smaller, more nearly circular, transverse cross-section adjacent the forward end which is open to receive the nested together projection 30 on the front vehicle 14 and the socket 44 of the rear vehicle 16. The launcher body is provided with a flat base or bottom wall 54 adapted to rest on a supporting surface and the rearward portion of the body includes a relatively large volume, pneumatic chamber 56 for containing a supply of compressed air for moving a captive piston element 60 on a rapid forward stroke when released, to impact or strike the tang 50 and propell or launch the toy vehicle 10 for rapid rolling movement away from the launching device.

Pressurized air is supplied to the chamber 56 by means of a hand operated pressure pump 62 including an internal cylinder 64 having a cup shaped piston 66 mounted for vertical sliding movement therein at the lower end of a stem 68. A handle 70 is provided at the upper end of the stem to provide a convenient means for reciprocating the stem up and down to pump pressurized air into the fluid chamber 56. The air enters the cylinder 64 through an inlet opening **56*a* in the upper wall of the chamber slightly larger in diameter than the stem 68 and flows past the piston skirt during upstrokes of the piston in the cylinder. On downstrokes of the piston, the air entrapped in the cylinder 64 is forced out through an opening 65 in the bottom wall past a check valve flap 67** and increases the pressure of fluid contained in the chamber.

At the forward end, the chamber 56 is formed with an elliptically-shaped opening **56*b* having a relatively thick, peripheral wall portion and adapted to slideably receive a skirt portion 72 integrally formed on a rear wall 74 of the captive piston element 60. The piston element includes a forwardly extending leg 76 having an inverted T-shaped transverse, cross-section with a rectangular-shaped end wall 78 at the forward end adapted to impact against the rearward end of the tang 50 on the vehicle 10 (as indicated by the arrow "B" in FIGS. 4 and 5) when the piston element 60** is released.

The forward end portion of the leg 76 and the end wall 78 of the piston element is guided during an impact stroke by the surfaces of a slot of inverted T-shaped, cross-section formed in a transverse wall segment 80 provided on the bottom wall 84. The wall segment 80 is spaced rearwardly from a parallel, transverse, wall segment 82 and the spaced walls provide a vertical guideway or passageway 84 in which is slideably disposed a trigger element 86 which extends transversely through aligned vertical slots or openings 88 formed in opposite sides of the launcher body 52.

Figure 6:
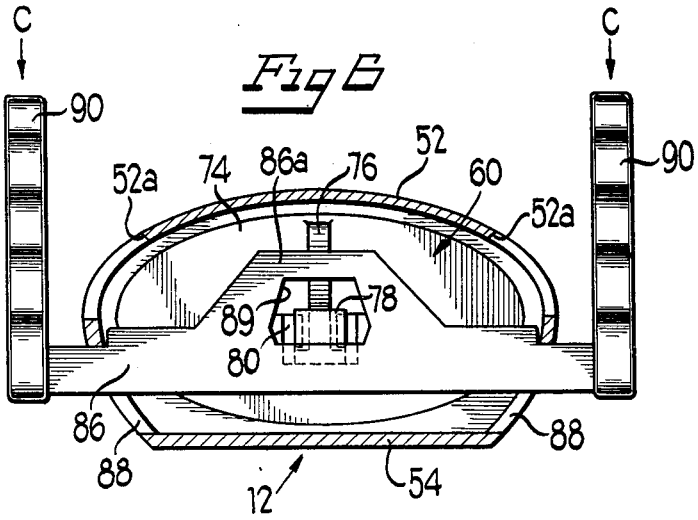
FIG. 6 is a transverse, cross-sectional view taken substantially along lines 6—6 of FIG. 4.

A pair of upstanding hand grips 90 are provided at the outer ends of the transverse trigger element 86 and when the hand grips are moved downwardly as indicated by the arrows "C" in FIGS. 5 and 6, the trigger element 86 is moved downwardly towards a piston releasing position enabling the compressed air within the chamber 56 to rapidly propell the piston element 60 in the direction of the arrow "B" to impact the tang 50 on the toy vehicle 10 thereby launching the vehicle outwardly away from the launcher 12.

As indicated in FIG. 6, the trigger element 86 includes an enlarged, upstanding, central portion 86*a* having an opening 89 of unique shape as shown in FIG. 6. When the trigger element 86 is in an upper or piston capturing position as shown in FIG. 6, a portion of the trigger element along the lower edge of the opening 89 is in positive holding engagement against the forward end wall 78 of the captive piston element 60. This capturing engagement prevents the piston element from moving forwardly on an impact stroke when there is pressurized air in the chamber 56. With the trigger element in the upper position, the interior of the fluid chamber 56 is filled with pressurized air by operation of the pump 62 to a desired high pressure level.

When it is desired to launch the toy vehicle 10, one or both of the trigger handles 90 is used to move the trigger element 86 downwardly until the lower edge of the opening 89 clears the underside of the forward end wall 78 on the captive piston element 60. When this occurs, the air pressure in the fluid chamber 56 rapidly ejects the piston element outwardly and the forward end wall 78 strikes the rear end of the tang 50 with an impact force sufficient to propel the toy vehicle 10 outwardly from the launcher 12. The forward impact on the tang 50 causes the thin wall or web 42 of the rear vehicle 16 to flex or bend in the middle and this results in the forward end portions of the side members 40 deflecting outwardly as indicated by the arrows "A" in FIG. 4 thereby releasing the latch fingers 41 from latching engagement with the recesses 27*a* in the sidewalls of the front vehicle 14. Even though the latch is released upon the initial impact of launching of the vehicle 10, the separate vehicle portions 14 and 16 move together in the nested configuration for a period of time because of the force of the rolling friction on the wheels which is initially sufficient to overcome the ejection force of the stretched rubberband 36. However, as the vehicle 10 begins to slow down, the frictional force exerted by the wheels begins to be reduced and the rubberband 36 then becomes effective to forcefully eject the front vehicle 14 forwardly away from the rear vehicle 16. This action also results in a more rapid braking action for stopping the forward motion of the rear vehicle 16 and closely simulates a second stage, after launching, of the separation of two parts of a multi-stage vehicle.

After a launching is accomplished, the captive piston element 60 is manually reset by pushing the element inwardly until the piston skirt 72 is again seated in the pressure chamber outlet opening 56*b*. The trigger element is then reset to the upper holding position and the pressure chamber 56 is then repressurized by operation of the air pump 62. The vehicle 10 with the portions 14 and 16 nested and latched together is then positioned on the launcher 12 ready for launching when the trigger handles 90 are depressed as illustrated in FIGS. 1, 4 and 5.

The captive piston element 60 is guided for linear movement from the holding position (FIGS. 4 and 5) in the direction of the arrow "B" and in a reverse direction during resetting by the sliding engagement between the piston skirt 72 and the surface of the chamber outlet opening 56*b*. In addition, forward portions of the piston element leg 76 and end wall 78 are supported for horizontal sliding movement by surfaces on the bottom of slots in the wall segments 80 and 82 having a shape like an inverted "T" as shown in FIG. 6. Vertical surfaces on opposite sides of these slots of inverted T-shape limit the extent of any lateral deviation of the piston element 60 during an impact stroke and during resetting. After the end wall 78 of the piston element strikes the tang 50 to propel the vehicle 10 away from the launcher 12 during the launching process, further forward travel of the piston element after the tang is ejected is arrested by engagement between the sloped upper surface of the leg 76 and the upper surface of the uniquely shaped opening 89 of the trigger element. This engagement also tends to bias the trigger element upwardly from the releasing or launching position toward the holding position and thus, initiates the resetting process. Later on, the tang 50 of the vehicle 10 may again be positioned in the ready position for the next launching after the piston element is manually returned or reset by inward pressure applied by a finger. The outer edge of the piston skirt 72 is tapered to facilitate inward movement of the piston element after a launch. The sloped upper edge of the leg 76 engages the upper edge of the opening 89 in the trigger element to arrest the forward travel of the piston element after a launch before the skirt 22 becomes fully disengaged from the outlet opening 56*b* of the pressure chamber 56 of the launcher.

The tapered shell or housing 52 of the launcher resembles a nose section of a rocket type vehicle and relatively large windows 52*a* are provided on opposite sides adjacent a forward end portion, to afford a view and access to the captive piston element 60 for resetting in preparation for the next launch.

The forward end portion of said body or housing 52 of the launcher 12 is open to form a socket for receiving the tang 50 and cup-like rear end projection 44 of the vehicle 10 in a launching position as shown in FIGS. 4 and 5. A transverse wall 92 provides a stop surface in the launcher body for the rear end wall of the vehicle projection 44 and the tang 50 projects further inwardly toward the piston end wall 78 through an opening 92*a* in the center of the wall. Forward end portions 94 of the launcher body 52 and the bottom wall 54 engage side wall portions of the vehicle rear end projection 44 and rear end wall as shown in FIGS. 4 and 5 when the vehicle is in position ready for launch and this engagement provides for holding the launcher 12 and vehicle 10 in longitudinal axial alignment until the launch is completed.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. A toy vehicle comprising:

a front portion including wheel means for supporting the same for rolling movement over a support surface;

a separate rear portion including wheel means for supporting the same for rolling movement over said support surface;

biasing means for ejecting said front portion away from said rear portion and means for connecting said biasing means to said vehicle;

detachable connector means for securing said front and rear portions nested together as a unit against the force of said biasing means until said unit is impacted in a forward direction to travel on said support surface.

2. The toy vehicle of claim 1 including impact receiving means on a rear end of said rear portion for propelling said unit forwardly to travel over said support surface upon receiving an impact from the rear.

3. The toy vehicle of claim 1 or 2 wherein said detachable connector means includes latch means engagable between surfaces on said front and rear portions for overcoming the ejection force of said biasing means until said unit is impacted to travel forwardly over said support surface.

4. The toy vehicle of claim 3 wherein said latch means is released by a forward impact force against said rear portion of said unit.

5. The toy vehicle of claim 3 wherein said rear portion includes a pair of side members interconnected by a transverse member, said members defining a nesting recess with an open forward end between free forward ends of said side members, said front portion nestable in said recess between said side members of said rear portion.

6. The toy vehicle of claim 5 wherein said latch means includes a first latch element on at least one of said side members normally engaging a second latch element on said front portion, said first element deflectable out of engagement with said second element by outward deflection of said one side member away from said front portion when said transverse member is impacted forwardly to propel said vehicle over said support surface.

7. The toy vehicle of claim 6 wherein said latch means includes a pair of said first latch element on opposite ones of said side members, said front portion having a pair of said second latch elements on opposite sides normally engaging said first latch elements and releasable upon outward deflection of said side members when said transverse member is impacted forwardly.

8. The toy vehicle of claim 3 wherein said biasing means includes an elongated elastic member adapted to engage surfaces of said rear portion and said front portion.

9. The toy vehicle of claim 1 wherein said detachable connector means includes socket forming means on one of said portions for receiving projection means on the other of said portions for maintaining said portions in selected alignment until impacted forwardly.

10. The toy vehicle of claim 2 in combination with launching means for the impact propulsion of said vehicle to release said detachable connector means.

11. The toy vehicle combination of claim 10 wherein said launching means includes a captive impact element releasable to strike said vehicle for propelling said portions forwardly over said supporting surface.

12. The toy vehicle combination of claim 11 wherein said launching means includes fluid pressure means for moving said impact element to strike said vehicle.

13. The toy vehicle combination of claim 11 including second detachable connector means for interconnecting said vehicle and said launching means in a ready position for launching by release of said impact element to strike said vehicle.

* * * * *